US006312266B1

(12) United States Patent
Fan et al.

(10) Patent No.: US 6,312,266 B1
(45) Date of Patent: Nov. 6, 2001

(54) CARRIER FOR LAND GRID ARRAY CONNECTORS

(75) Inventors: Zhineng Fan, Ithaca, NY (US); Ai D. Le, Sunnyvale, CA (US); Che-Yu Li, Ithaca, NY (US)

(73) Assignee: High Connection Density, Inc., Sunnyvale, CA (US)

( * ) Notice: Subject to any disclaimer, the term of this patent is extended or adjusted under 35 U.S.C. 154(b) by 0 days.

(21) Appl. No.: 09/645,860

(22) Filed: Aug. 24, 2000

(51) Int. Cl.[7] ..... H01R 4/58
(52) U.S. Cl. ..... 439/91
(58) Field of Search ..... 439/91, 66, 591, 439/71

(56) References Cited

U.S. PATENT DOCUMENTS 6,114,757 * 9/2000 DelPrete ..... 439/71
6,175,517 * 1/2001 Jiguor et al. ..... 365/63

* cited by examiner

*Primary Examiner*—Neil Abrams
*Assistant Examiner*—Phuong KT Dinh
(74) *Attorney, Agent, or Firm*—Salzman & Levy

(57) ABSTRACT

The present invention provides a carrier that provides improved retention to the individual contact elements resulting in LGA interposer connectors with improved manufacturability, reliability and more uniform mechanical and electrical performance. In one embodiment, the carrier, which includes upper and lower sections of dielectric material with an adhesive layer in between, includes a plurality of openings, each of which may contain an individual contact element. During assembly of the connector, once the contact elements are inserted, the adhesive layer is reflowed, thereby allowing the carrier to capture the location of the contact elements both with respect to each other as well as to the carrier. Alternately, the carrier may be implemented in a fashion that, while not including an adhesive layer to be reflowed, still provides improved retention of the individual contact elements. These embodiments may by easier to assemble, and less expensive to manufacture, especially in high volumes. Description of the processes to assemble the carrier and overall connector are also disclosed.

28 Claims, 9 Drawing Sheets

CARRIER FOR LAND GRID ARRAY CONNECTORS

RELATED PATENT APPLICATIONS

This application is related to copending U.S. patent application Ser. No. 09/457,776, filed Dec. 9, 1999 and copending U.S. patent application Ser. No. 09/866,434, filed May 29, 2001, both of which are hereby incorporated by reference.

FIELD OF THE INVENTION

The present invention relates to electrical connectors for interconnecting at least two electrical circuit members such as printed circuit boards, circuit modules, or the like and, more particularly, to connectors of this type, which may be used in information handling system (computer) or telecommunications environments.

BACKGROUND OF THE INVENTION

The current trend in design for connectors utilized in high speed electronic systems is to provide both high density and highly reliable connections between various circuit devices, which form important parts of those systems. The system may be a computer, a telecommunications network device, a handheld "personal digital assistant", medical equipment, or any other electronic equipment. High reliability for such connections is essential due to potential end product failure, should vital misconnections of these devices occur. Further, to assure effective repair, upgrade, and/or replacement of various components of the system (i.e., connectors, cards, chips, boards, modules, etc.), it is also highly desirable that such connections be separable and reconnectable in the field within the final product. Such a capability is also desirable during the manufacturing process for such products in order to facilitate testing, for example.

A land grid array (LGA) is an example of such a connection in which the two primarily parallel circuit elements to be connected each has a plurality of contact points, arranged in a linear or two-dimensional array. An array of interconnection elements, known as an interposer, is placed between the two arrays to be connected, and provides the electrical connection between the contact points or pads.

LGA interposers described in the prior art are implemented in many different ways. Of interest in this patent application are those interposers that include an insulative carrier with an array of primarily circular openings, each of which may contain a single contact element. The contact elements extend vertically both above and below the carrier. The retention of the contact elements provided by the carrier is minimal. Examples of these interposers are described in U.S. Pat. Nos. 4,922,376, 5,163,834, 5,473,510, 5,949,029 and 5,599,193, and in connectors bearing the trademark, "Cin::apse" from Cinch Connectors, a division on Labinal Components and Systems, Inc., and the trademark, "Fuzz Button" from Tecknit USA.

At first viewing some of the elements of U.S. Pat. No. 5,599,193 appear similar to those of various embodiments of the invention, but further study shows significant differences are present. The embodiment in FIGS. 1 and 2 describes an LGA connector with non-conductive elastomeric elements formed at the same time as the elastomeric carrier for the elements through a process such as molding. The elastomeric elements are selectively plated on their outer surface to create a plurality of conductive elements. Unfortunately, since the elastomeric elements are integrally formed with the carrier, it would be extremely difficult to repair a conductive element that has been damaged. Therefore the entire connector must be scrapped. Furthermore, since the carrier is composed of elastomer, its coefficient of thermal expansion (CTE) is substantially different than the surrounding structures.

The embodiment in FIGS. 4 and 5 of U.S. Pat. No. 5,599,193 describes an LGA connector with a rigid carrier that has openings with a shape complementary to the externally conductive elastomeric elements. While such an embodiment provides retention of the conductive elements, it would be difficult to implement such a structure with the low profile necessary to meet today's stringent mechanical and electrical requirements.

The individual cavities in the carriers for most of these connectors are cylindrical in shape and provide a minimal amount of retention of individual contact elements. Unfortunately, this makes the assembly and the proper engagement of the connector more difficult, since the individual contact elements may tend to fall out or shift vertically. Although a missing contact element will always result in an open circuit, an element shifted vertically may lead to problems maintaining uniform electrical and mechanical properties, thereby significantly reducing the reliability of the interconnection.

It is believed that a carrier that provides improved retention of the individual contact elements will result in LGA interposer connectors with improved manufacturability, reliability and more uniform mechanical and electrical performance, constituting a significant advancement in the art.

It is, therefore, an object of the invention to enhance the electrical connector art.

It is another object of the invention to provide a carrier for land grid array connectors with improved contact element retention.

It is an additional object of the invention to provide a carrier for land grid array connectors that results in a connector with improved manufacturability.

It is an additional object of the invention to provide a low profile carrier and land grid array connector combination.

It is an additional object of the invention to provide a carrier and land grid array connector combination that is reworkable if a contact member is damaged.

It is a still further object of the invention to provide a carrier for land grid array connectors that results in a connector with uniform electrical and mechanical performance.

SUMMARY OF THE INVENTION

The present invention provides a carrier that provides improved retention to the individual contact elements resulting in LGA interposer connectors with improved manufacturability, reliability and more uniform mechanical and electrical performance. In one embodiment, the carrier, which includes upper and lower sections of dielectric material with an adhesive layer in between, includes a plurality of openings, each of which may contain an individual contact element. During assembly of the connector, once the contact elements are inserted, the adhesive layer is reflowed, thereby allowing the carrier to capture the location of the contact elements both with respect to each other as well as to the carrier. Alternately, the carrier may be implemented in a fashion that, while not including an adhesive layer to be reflowed, still provides improved retention of the individual contact elements. These embodiments may by easier to assemble, and less expensive to manufacture, especially in high volumes. Description of the processes to assemble the carrier and overall connector are also disclosed.

BRIEF DESCRIPTION OF THE DRAWINGS

A complete understanding of the present invention may be obtained by reference to the accompanying drawings, when taken in conjunction with the detailed description thereof and in which.

DETAILED DESCRIPTION OF THE PREFERRED EMBODIMENT

Generally speaking, the present invention is a carrier that provides improved retention to the individual contact elements of LGA interposer connectors. Improved manufacturability, reliability and more uniform mechanical and electrical performance are achieved with this invention.

Figure 1A:
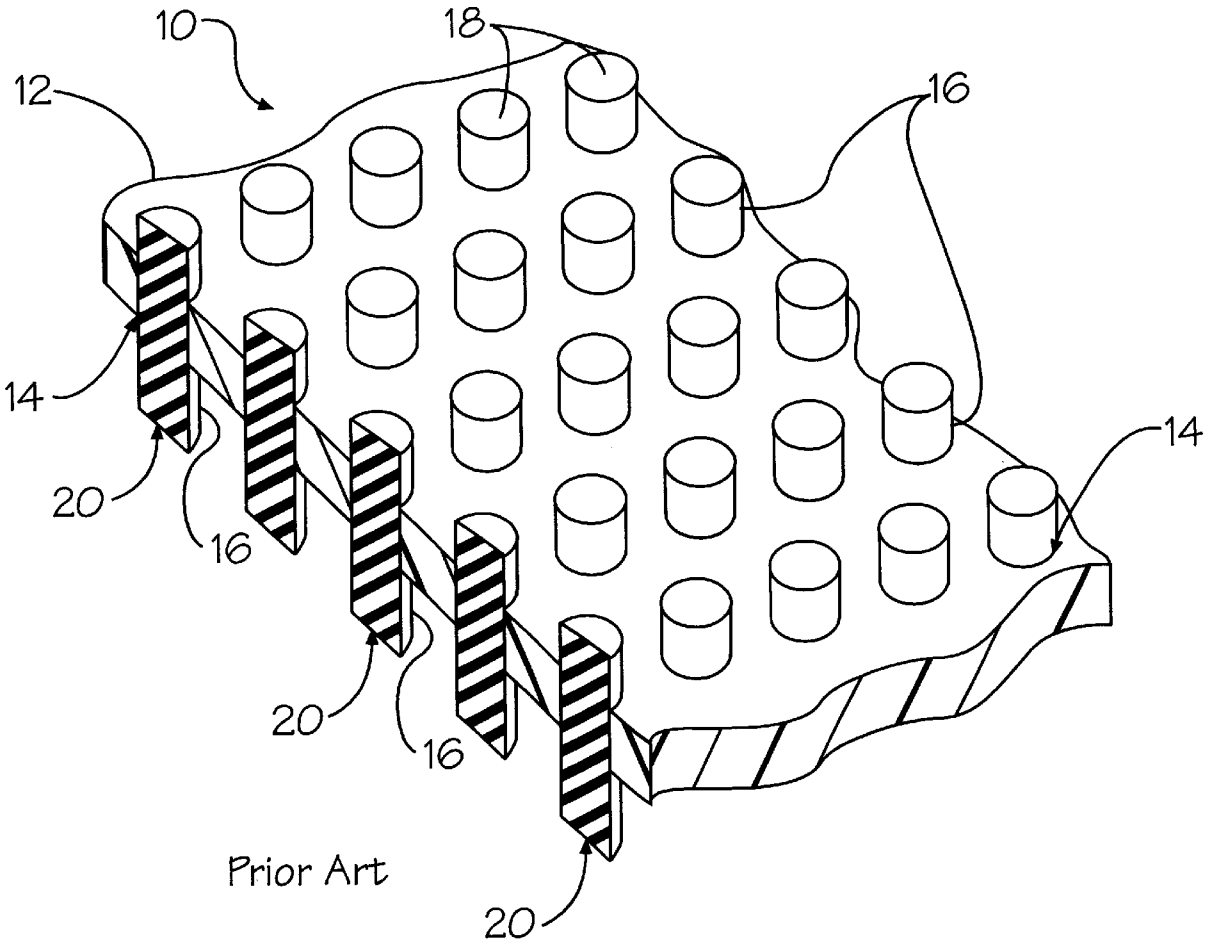
FIG. 1*a* is a partial perspective view of an electrical connector in accordance with the prior art.
Figure 1B:
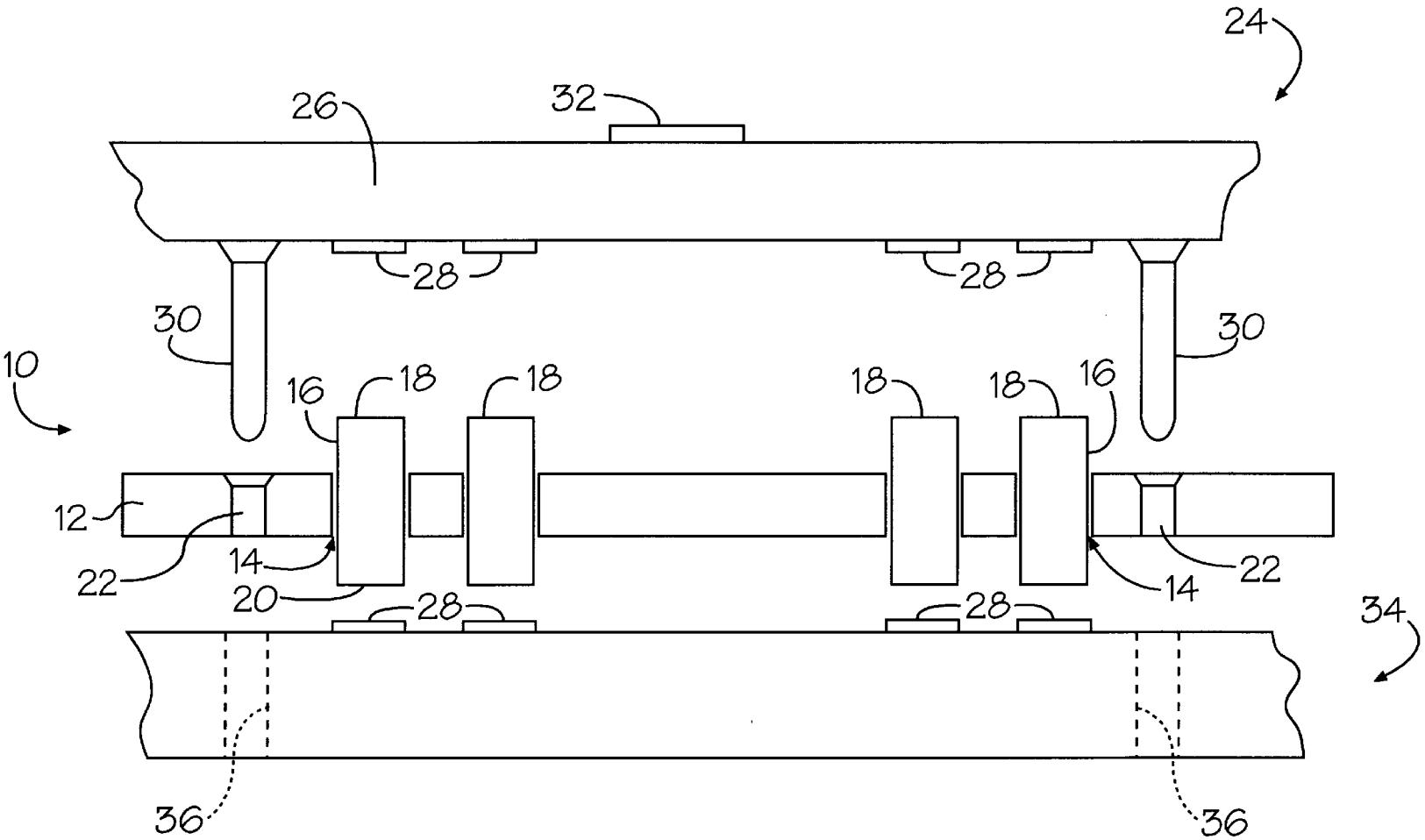
Prior Art Figure 1b
FIG. 1*b* is a side view, in section and on an enlarged scale, of a prior art connector shown in FIG. 1*a*, the connector being located between and in alignment with a pair of circuit members for eventually providing interconnection therebetween.

Referring first to FIGS. 1*a* and 1*b*, there are shown perspective and side views, respectively, of a connector 10 of the prior art for electrically interconnecting a pair of electrical circuit members 24 and 34. Examples of circuit members suitable for interconnection by connector 10 include printed circuit boards, circuit modules, etc. The term "printed circuit board" is meant to include but not be limited to a multilayered circuit structure including one or more conductive (i.e. signal, power and/or ground) layers therein. Such printed circuit boards, also known as printed wiring boards, are well known in the art and further description is not believed necessary. The term "circuit module" is meant to include a substrate or like member having various electrical components (e.g., semiconductor chips, conductive circuitry, conductive pins, etc.), which may form part thereof. Such modules are also well known in the art and further description is not believed necessary.

Connector 10 includes a common, electrically insulative carrier member 12 having a plurality of internal apertures or openings 14. The openings 14 are typically cylindrical in shape. Resilient contact members 16 are located so as to substantially occupy a respective opening 14 in carrier member 12.

Each opposing end 18 and 20 of each contact member 16 is designed for electrically contacting respective circuit members. As stated, these circuit members may be printed circuit boards 34 having flat conductive pads (e.g., copper terminals) 28 located on an upper surface thereof. These circuit members may also comprise a circuit module 24 including a substrate 26 having a plurality of semiconductor elements 32 thereon and corresponding thin, flat, copper conductive pads 28 located on a bottom, external surface. The conductive pads 28 are, understandably, electrically coupled to corresponding circuitry, which forms part of the respective electrical circuit members. These pads 28 may provide signal, power or ground connections, depending on the operational requirements of the respective circuit member.

Connector 10 is designed for being positioned between opposing circuit members 24 and 34, and for being aligned therewith. Such alignment may be possible by placement of the carrier member 12, which may also include alignment openings 22.

Each resilient contact member 16 is thus compressed during engagement to form the appropriate interconnection between corresponding pairs of conductive pads 28.

As discussed hereinabove, openings 14 in carrier member 12, typically cylindrical in shape, provide a minimal amount of retention of individual resilient contact members 16. Unfortunately, this makes the assembly and the proper engagement of the connector more difficult, since the individual contact elements may tend to fall out or shift vertically. Although a missing contact element will always result in an open circuit, a shifted element may lead to problems maintaining uniform electrical and mechanical properties, thereby significantly reducing the reliability of the interconnections.

Figure 2A:
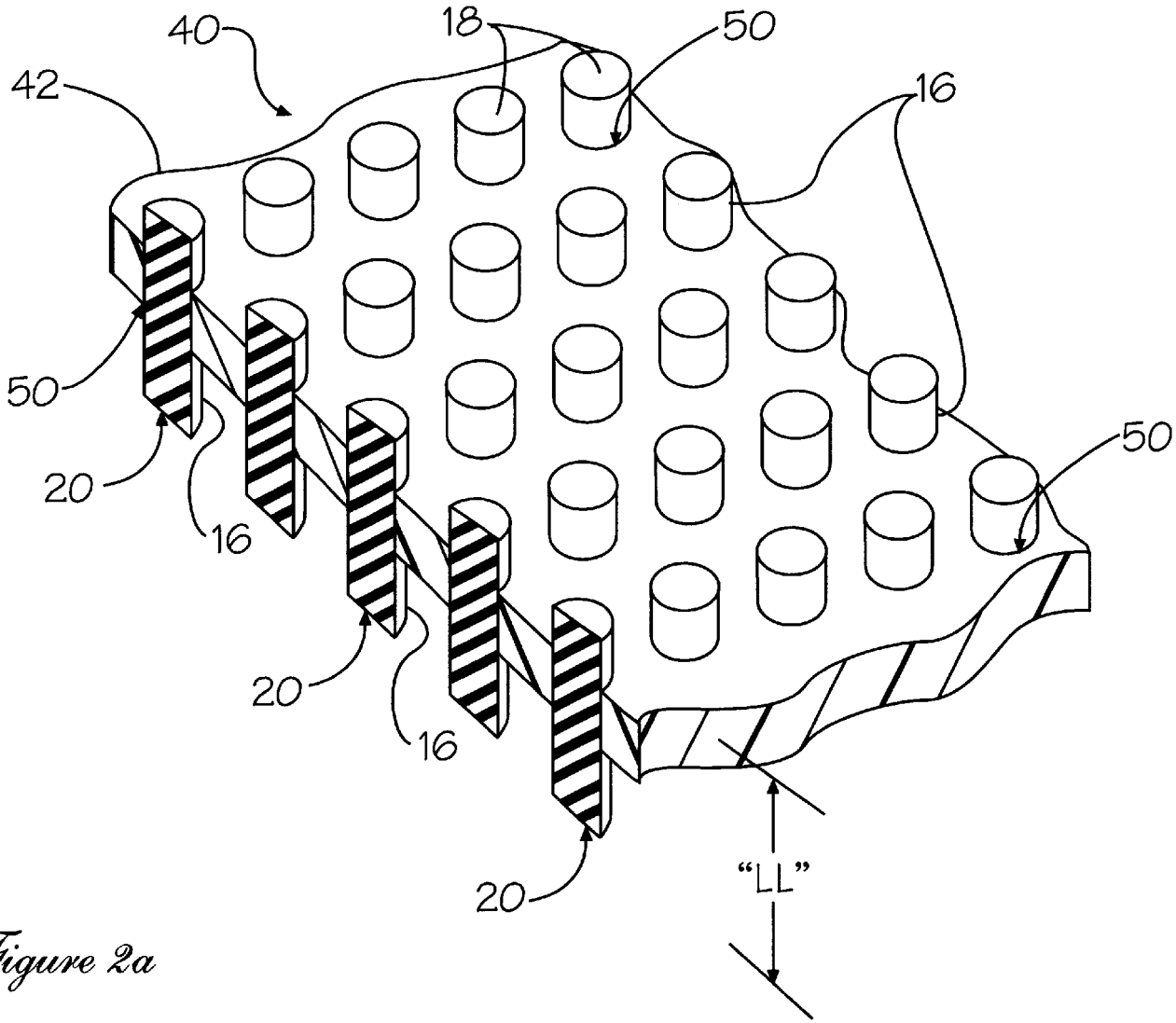
FIG. 2*a* is a partial perspective view of an electrical connector in accordance with one embodiment of the present invention.
Figure 2B:
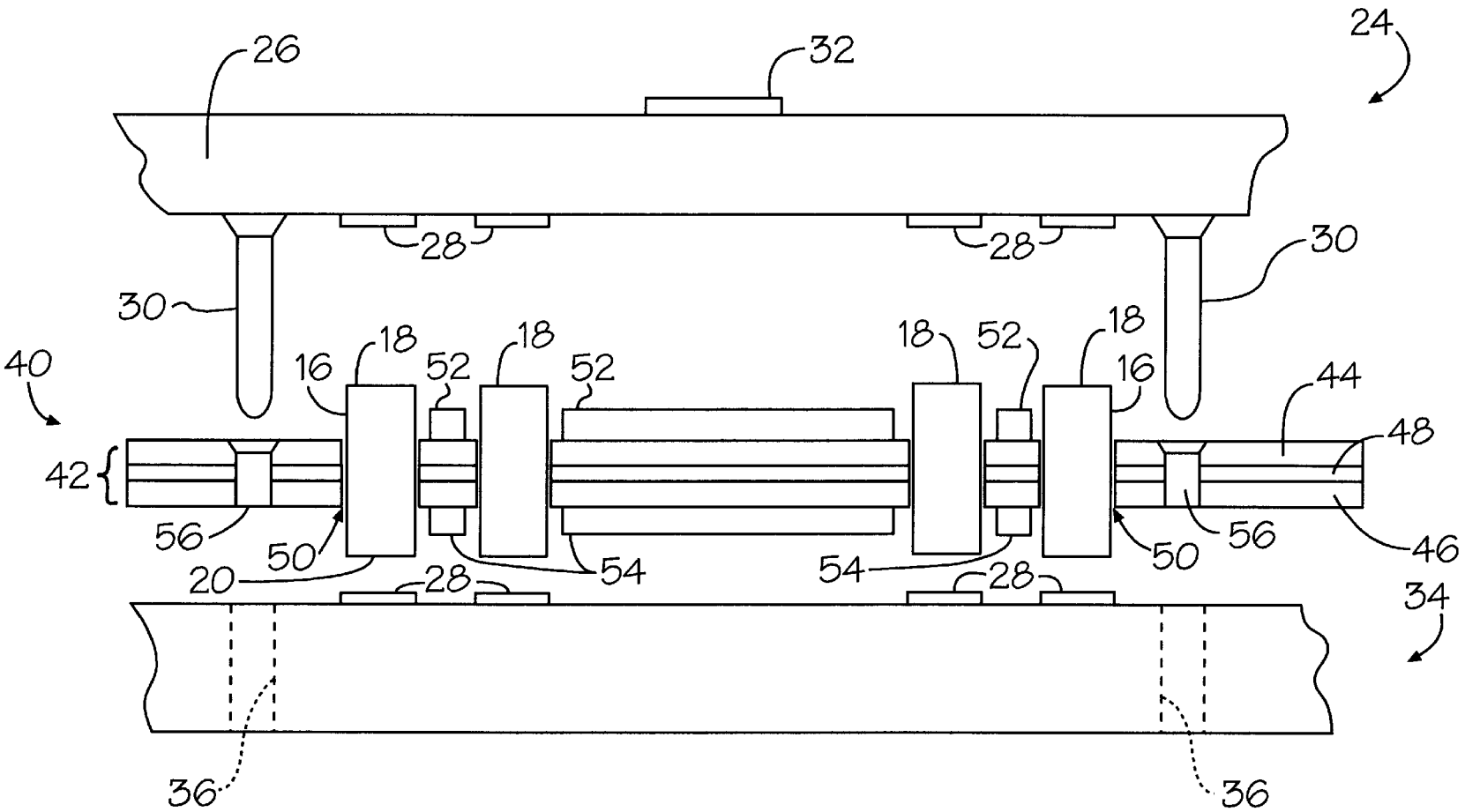
FIG. 2*b* is a side view, in section and on an enlarged scale, of the connector shown in FIG. 2*a*.

Referring now to FIGS. 2*a* and 2*b*, there is shown perspective and side views, respectively, of a connector 40 of the present invention for electrically interconnecting a pair of electrical circuit members 24 and 34. Examples of suitable circuit members include printed circuit boards, circuit modules, etc.

Connector 40 includes a common, electrically insulative carrier member 42 having a plurality of internal openings 50. In contrast to the prior art carrier member 12 (FIG. 1*a*), electrically insulative carrier member 42 consists of an upper section 44, upper spacers 52, a lower section 46, and lower spacers 54, with an adhesive layer 48 between the upper and lower sections 44, 46. In one example of this embodiment, the openings 50 are cylindrical in shape. Each resilient contact member 16 is located so as to substantially occupy an opening 50 in carrier member 42.

Although resilient contact members 16 may be of the type as shown in the prior art, they are preferably of a construction and composition as that taught in copending U.S. patent application Ser. No 09/457,776.

In one example of the invention, each resilient contact member 16 may possess a diameter of about 0.026 inch and a corresponding length (dimension LL in FIG. 2*a*) of about 0.040 inch. Openings 50 have a diameter of 0.028 inch, just a few thousandths of an inch larger than the contact members. The center-to-center distance is 0.050 inch, but could be reduced to about 0.040 inch if required.

In this embodiment, upper section 44 and lower section 46 are made of epoxy-glass-based materials typically used in printed circuit board fabrication (e.g., FR4). These materials are preferred because their coefficient of thermal expansion (CTE) substantially matches the CTE of the surrounding structures, and because of their relatively low cost. Each section 44 and 46 is 0.007 inch thick. Layer 48 consists of a 0.002-inch layer of pressure sensitive adhesive (PSA). One company that manufactures appropriate adhesive layers is Minnesota Mining and Manufacturing Company (3M). Layer 48 may consist of other materials including prepreg.

Once an appropriate combination of pressure and temperature is applied to connector 40 during assembly, the adhesive layer 48 of PSA reflows and attaches conductive members 16 to carrier member 42, thereby capturing contact members 16 and uniformly maintaining their location/position relative to each other as well as to carrier member 42. It should be noted that FIGS. 2*a* and 2*b* show connector 40 prior to the reflow of adhesive layer 48.

While a carrier 40 with single layers for the upper section 44, upper spacers 52, lower section 46, lower spacers 54, and adhesive layer 48 between the upper and lower sections 44, 46 has been chosen for purposes of disclosure, it should be obvious that the principles taught by the instant invention can also be applied to structures having multiple layers for one or more the elements listed above. For example, for certain applications it may be desirable to split upper section 44 and lower section 46 in half and include an additional adhesive layer between each of the two halves, thereby increasing the amount of adhesive for retention of conductive members 16.

Upper spacers 52 and lower spacers 54 are also made of epoxy-glass-based materials typically used in printed circuit board fabrication ge.g., FR4). These materials are preferred because their CTE substantially matches the CTE of the surrounding structures, and because of their relatively low cost. Each spacer 52 and 54 is 0.0055 inch thick. The overall thickness of carrier member 42 (including the upper and lower sections, the upper and lower spacers, and the adhesive layer) is 0.027 inch. The function of spacers 52 and 54 is to limit the maximum amount that contact members 16 may be compressed, which is from 0.040 to 0.027 inch in this particular case.

The inclusion of adhesive layer 48 in electrically insulative carrier member 42 helps to alleviate deficiencies of the prior art carrier, those being to ensure that contact members 16 do not fall out during assembly or engagement, and more commonly, to ensure that all individual contact members maintain uniform electrical and mechanical properties, thereby significantly improving the reliability of the interconnections.

As with the prior art, each opposing end 18 and 20 of resilient contact member 16 is designed for electrically contacting respective circuit members. These circuit members may be printed circuit boards 34 having flat conductive pads (e.g., copper terminals) 28 located in an upper surface thereof. These circuit members may also comprise a circuit module 24 including a substrate 26 having a plurality of semiconductor elements 32 thereon and corresponding flat conductive pads (e.g., thin copper elements) 28 located on a bottom, external surface. The conductive pads 28 are, understandably, electrically coupled to corresponding circuitry, which forms part of the respective electrical circuit members. These pads 28 may provide signal, power or ground connections, depending on the operational requirements of the respective circuit member. It is preferred that conductive pads 28 be plated with a layer of metal (e.g., gold) to ensure reliable interconnection to connector 40.

Connector 40 is positioned between opposing circuit members 24 and 34, and is aligned therewith. Such alignment may be possible by placement of the carrier member 42, which also includes alignment openings 56.

Alignment of the circuit members 24 and 34 relative to interim connector 40 may be provided utilizing a pair of protruding pins 30 which extend from one of the circuit members (e.g., module 24), these pins being aligned with and positioned within corresponding openings 56 within carrier member 42 and openings 36 (shown hidden) within the other circuit member 34. It should be understood that other means of alignment are readily possible, including the provision of pins extending from opposing surfaces of carrier member 42 for inversion within corresponding openings within the respective circuit members. To adjust for tolerancing, one of the openings 56 within connector 40 may be of an elongated configuration, forming a slot, for example.

Each resilient contact member 16 is thus compressed during engagement to form the appropriate interconnection between corresponding pairs of conductive pads 28.

Carrier member 42 may be constructed in many different ways. A preferred method is to start by removing the protective sheet from one side of an adhesive layer and to laminate to either the upper or lower section of FR4. In one case a temperature of 185 degrees F. and a pressure of 20 pounds per square inch (PSI) were used. Once this operation is complete, remove the protective sheet from the other side of an adhesive layer/FR4 laminate and laminate it to the other section of FR4. A computer numerically controlled (CNC) drilling machine can then be used to create the upper and lower spacers, to drill openings and alignment holes and/or slots as required, and to define the overall outer edges of the carrier member.

Another method to construct carrier member 42 is to start by removing the protective sheet from one side of an adhesive layer and to laminate to either the upper or lower section of FR4. This time, however, the FR4 layer is thinner and used to create only the upper and lower sections, not the upper and lower spacers. Once this operation is complete, remove the protective sheet from the other side of an adhesive layer/FR4 laminate and laminate it to another thinner section of FR4. Upper and lower spacer layers can be created separately and then laminated to the FR4/adhesive/FR4 composite, preferably after the CNC drilling operations described above are completed.

A method for constructing the overall connector 40 is to start with a fixture that will hold the bottom surface of the carrier member a distance equivalent to the distance that the conductive members should protrude below the carrier member. Once the carrier is aligned to the fixture, conductive members are inserted in the openings and held in place by means such as a vacuum. A proper combination of temperature and force can then be applied to the assembly to allow the adhesive layer to reflow and to attach the conductive members to the carrier member, thereby capturing contact members and uniformly maintaining their location/position relative to each other as well as to the carrier member.

Figure 3A:
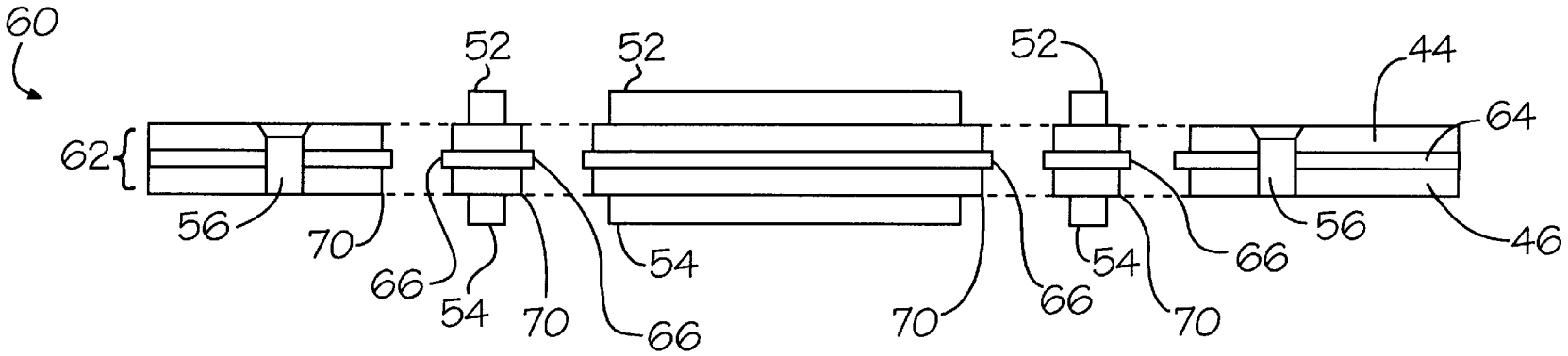
FIG. 3*a* is a side view of a carrier for an electrical connector in accordance with a second embodiment of the present invention.
Figure 3B:
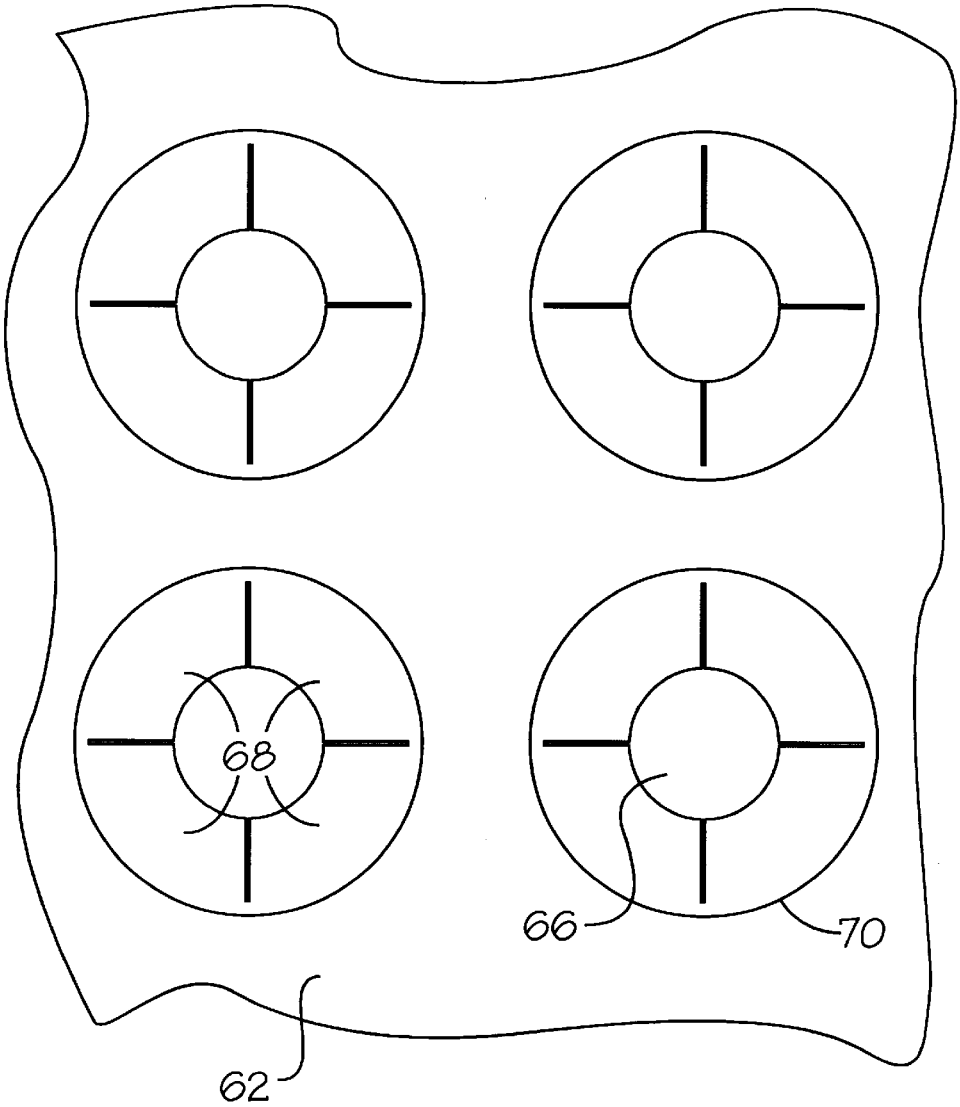
FIG. 3*b* is a top view, and on an enlarged scale, of the carrier shown in FIG. 3*a*.

Referring now to FIGS. 3*a* and 3*b*, there are shown side and top views, respectively, of an electrically insulative carrier member 62 to be used as part of a connector in accordance with an alternate embodiment of the invention. A pair of electrical circuit members 24 and 34 can be electrically interconnected.

The primary purpose for using carrier member 62 over prior art carriers is the same as for carrier member 42 (FIG. 2*b*): to better retain the conductive members 16 during both assembly and actual operation.

The cross section of electrically insulative carrier member 62 is similar to that of carrier member 42 of the previous embodiment with the primary difference being that adhesive layer 48 (FIG. 2*b*) is replaced by retention layer 64. In one example, retention layer 64 is made of Mylar (a trademark of E. I. DuPont deNemours & Co., Wilmington, Del.) and is 0.002-inch thick. For the elements and materials common to both this example and that shown in FIG. 2*b*, the dimensions and materials of said elements are unchanged. For example, the thickness of upper section 44 in one case is still 0.007 inch and preferably of an epoxy-glass-based material such as FR4 for the reasons previously mentioned. Since the thickness of retention layer 64 is the same thickness ac that of adhesive layer 48 (0.002 inch), the overall thickness of carrier member 62 is still 0.027 inch, the same as that: of carrier member 42.

Retention layer 64 has a plurality of smaller openings 66 formed by a plurality of retention segments 68 that are created by the removal of a portion of retention layer 64 and the segmentation of the remaining material within a larger opening 70 in carrier member 62. In one example each larger opening 70 contains four retention segments 68 that form primarily circular smaller opening 66. The specific dimensions of each of the elements of this invention can be varied to produce the desired amount of retention force on conductive members 16 (not shown in this figure).

Carrier member 62 provides a tradeoff of performance versus ease-of-manufacturability compared to carrier member 42 (FIG. 2*b*). While carrier member 62 provides improved retention of conductive members 16 compared to the prior art, it would probably not be as high as the retention of reflowed adhesive layer 48 of carrier member 42. On the other hand, carrier member 62 does not require the application of heat and pressure during the assembly process.

Figure 4A:
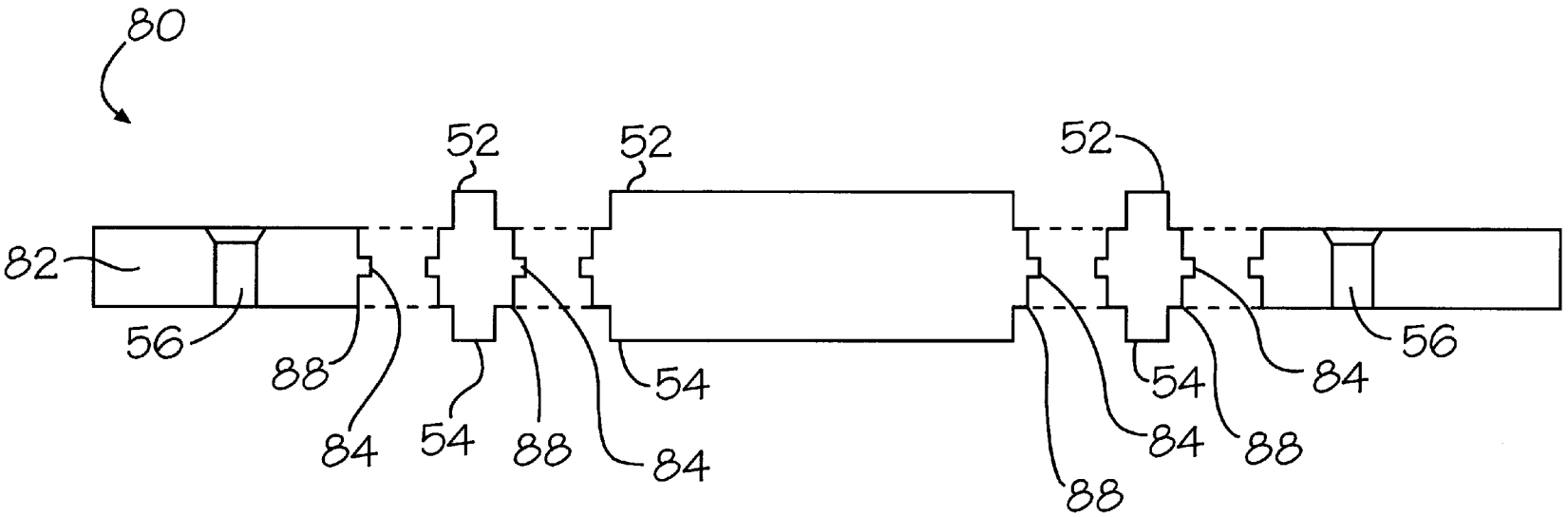
FIG. 4*a* is a side view of a carrier for an electrical connector in accordance with a third embodiment of the invention.
Figure 4B:
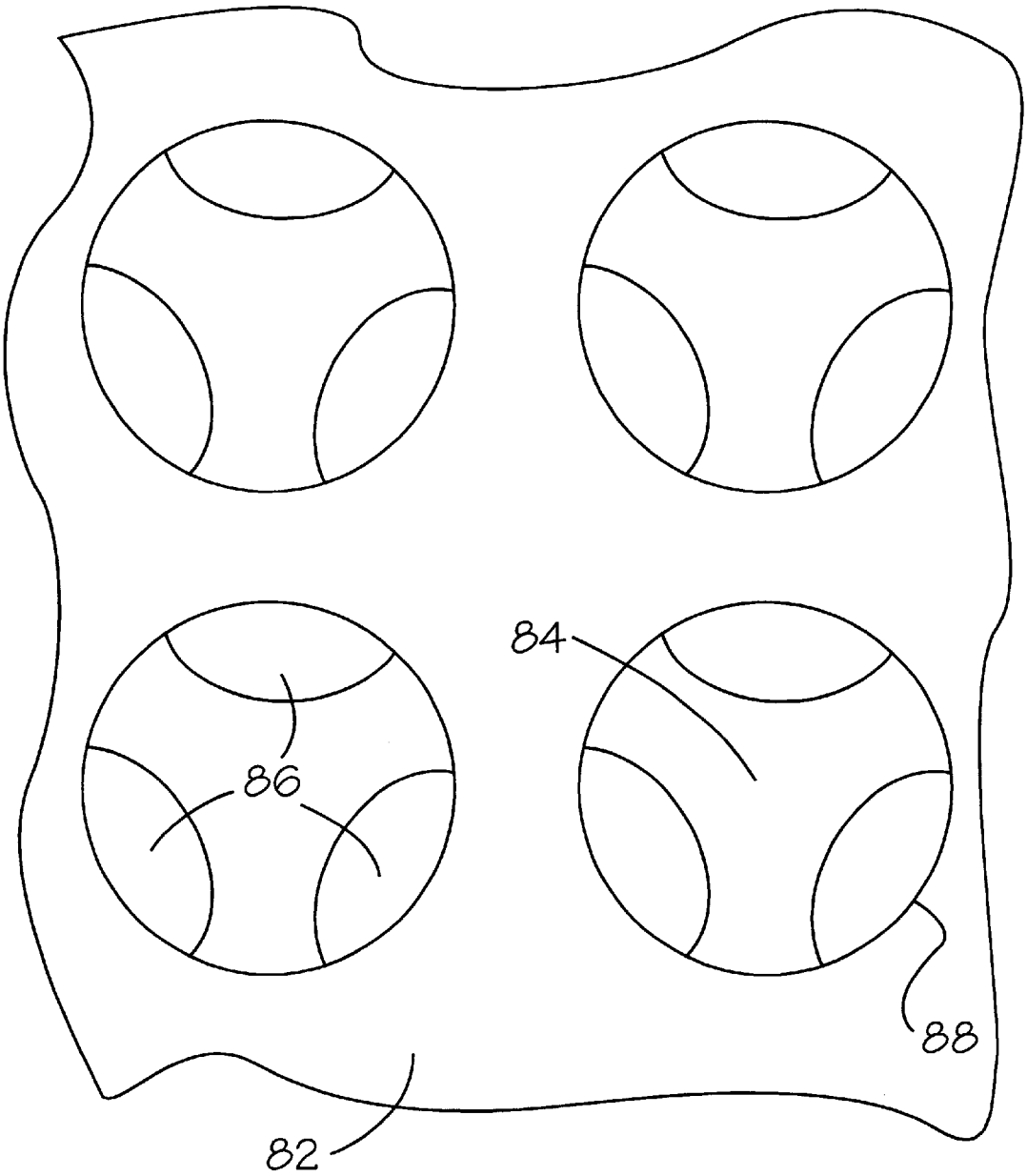
FIG. 4*b* is a top view, and on an enlarged scale, of a carrier shown in FIG. 4*a*.

Referring now to FIGS. 4*a* and 4*b*, there are shown side and top views, respectively, of an electrically insulative carrier member 82 to be used a part of a connector in accordance with another embodiment of the invention. The cross section and dimensions of electrically insulative carrier member 82 are similar to other inventive carrier members described hereinabove, and particularly that of carrier member 62 (FIGS. 3*a* and 3*b*), with the primary difference being that the previous multilayered structures are replaced by a single, unified structure. The benefits of this approach are for ease of Manufacture, and for ultimately lower cost, especially in high-volume production.

Carrier member 82 has a plurality of smaller openings 84 formed by a plurality of retention segments 86 within larger openings 88. In one example, each larger opening 88 contains three retention segments 86 that form smaller opening 84. The specific dimensions of each of the elements of this invention can again be varied to produce the desired amount of retention force on conductive members 16 (not shown in this figure).

In one example, carrier member 82 is formed by molding a plastic material such as a liquid crystal polymer (LCP). Suitable examples of LCP are Vectra (a trademark of Hoechst Celanese Corporation) and Ryton (a trademark of Philips Petroleum Company).

Figure 4C:
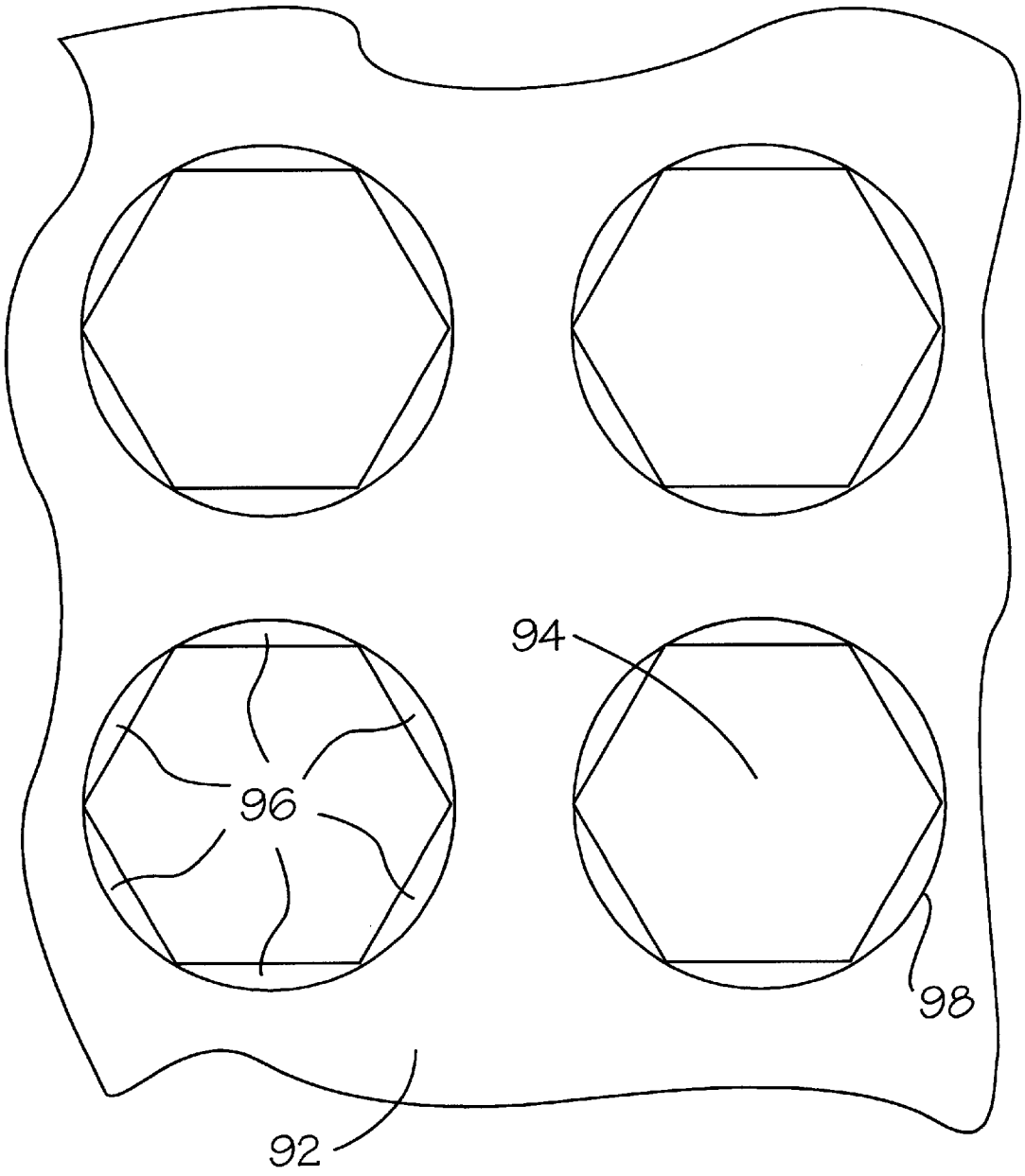
FIG. 4*c* is a top view, and on an enlarged scale, of another example of a carrier for an electrical connector in accordance with the embodiment shown in FIGS. 4*a* and 4*b*.

Referring now to FIG. 4*c*, there is shown a top view, and on an enlarged scale, of another example of an electrically insulative carrier member 92 for an electrical connector in accordance with the embodiment shown in FIGS. 4*a* and 4*b*.

Carrier member 92 has a plurality of smaller openings 94 formed by a plurality of retention segments 96 within larger openings 98. In one example, each larger opening 98 contains three retention segments 86 that form smaller opening 94. The specific dimensions of each of the elements of this invention can again be varied to produce the desired amount of retention force on conductive members 16 (not shown in this figure).

Since other modifications and changes varied to fit particular operating requirements and environments will be apparent to those skilled in the art, this invention is not considered limited to the examples chosen to purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A carrier for land grid array connectors, comprising:

a) a substrate having at least one upper section, at least one lower section, at least one adhesive layer located intermediate said upper and lower sections;

b) a plurality of openings in said substrate, each of said openings positioned to accept a contact member; and c) at least one contact member;

said adhesive layer contacting at least a portion of said contact member and providing retention thereof.

2. The carrier for land grid array connectors as recited in claim 1, wherein said upper and lower sections of said substrate comprise an insulative material.

3. The carrier for land grid array connectors as recited in claim 2, wherein said insulative material is epoxy-glass-based.

4. The carrier for land grid array connectors as recited in claim 3, wherein said insulative material comprises FR4.

5. The carrier for land grid array connectors as recited in claim 1, wherein said adhesive layer comprises a pressure sensitive adhesive.

6. The carrier for land grid array connectors as recited in claim 1, wherein said substrate further comprises a plurality of spacers.

7. The carrier for land grid array connectors as recited in claim 6, wherein said plurality of spacers is located above said upper section.

8. The carrier for land grid array connectors as recited in claim 6, wherein said plurality of spacers is located below said lower section.

9. The carrier for land grid array connectors as recited in claim 6, wherein said spacers comprise an insulative material.

10. The carrier for land grid array connectors as recited in claim 9, wherein said insulative material is epoxy-glass-based.

11. The carrier for land grid array connectors as recited in claim 10, wherein said insulative material comprises FR4.

12. The carrier for land grid array connectors as recited in claim 1, wherein said openings are substantially cylindrical.

13. The carrier for land grid array connectors as recited in claim 1, wherein said substrate further comprises alignment means.

14. A carrier for land grid array connectors, comprising:

a) a substrate having an upper section, a lower section, and at least one edge;

b) a plurality of openings in said substrate, each of said openings positioned to accept a contact member;

c) at least one contact member; and d) a middle layer located between said upper and lower sections of said substrate, said middle layer comprising a plurality of spaced apart retention segments extending into at least one of said openings to retain at least a portion of said at least one contact member.

15. The carrier for land grid array connectors as recited in claim 14, wherein said upper and lower sections of said substrate comprise an insulative material.

16. The carrier for land grid array connectors as recited in claim 15, wherein said insulative material is epoxy-glass-based.

17. The carrier for land grid array connectors as recited in claim 16, wherein said insulative material comprises FR4.

18. The carrier for land grid array connectors as recited in claim 14, wherein said middle layer comprises an insulative material.

19. The carrier for land grid array connectors as recited in claim 14, wherein said substrate further comprises a plurality of spacers.

20. The carrier for land grid array connectors as recited in claim 19, wherein said plurality of spacers is located above said upper section.

21. The carrier for land grid array connectors as recited in claim 19, wherein said plurality of spacers is located below said lower section.

22. The carrier for land grid array connectors as recited in claim 19, wherein said spacers comprise an insulative material.

23. The carrier for land grid array connectors as recited in claim 22, wherein said insulative material is epoxy-glass-based.

24. The carrier for land grid array connectors as recited in claim 23, wherein said insulative material comprises FR4.

25. The carrier for land grid array connectors as recited in claim 14, wherein said openings are substantially cylindrical.

26. The carrier for land grid array connectors as recited in claim 14, wherein said substrate further comprises alignment means.

27. The carrier for land grid array connectors as recited in claim 14, wherein said upper section, lower section, and middle layer of said substrate are integrally formed.

28. The carrier for land grid array connectors as recited in claim 27, wherein said substrate is integrally formed by a process selected from the group consisting essentially of molding, casting, milling, stamping and etching.

* * * * *